United States Patent [19]

Filter et al.

[11] 3,972,820

[45] Aug. 3, 1976

[54] FIRE EXTINGUISHING COMPOSITION

[75] Inventors: Harold E. Filter, Midland; Don L. Stevens, Sanford, both of Mich.

[73] Assignee: The Dow Chemical Company, Midland, Mich.

[22] Filed: Dec. 20, 1973

[21] Appl. No.: 426,885

[52] U.S. Cl. ..... 252/5; 149/83; 149/87; 252/4; 428/921

[51] Int. Cl.[2] ..... A62C 1/00; A62D 1/00; C06B 29/08

[58] Field of Search ..... 252/4, 5, 187 R; 149/83, 87; 169/43, 46, 44, 47, 12; 428/921, 922; 117/137, 136

[56] References Cited

UNITED STATES PATENTS

| | | | |
|---|---|---|---|
| 7,269 | 4/1850 | Phillips | 169/12 |
| 3,467,558 | 9/1969 | Wernette et al. | 149/83 |
| 3,704,187 | 11/1972 | Kott et al. | 149/83 |

*Primary Examiner*—Benjamin R. Padgett
*Assistant Examiner*—Josephine Lloyd
*Attorney, Agent, or Firm*—Stephen R. Wright; Glenn H. Korfhage

[57] ABSTRACT

Disclosed is a novel fire extinguishing composition comprising a heat and gas producing pyrotechnic composition comprising a binder and an oxidizer, and having dispersed therein a halogen containing fire extinguishing agent. The pyrotechnic, when ignited, thermally disseminates the fire extinguishing agent onto the fire.

12 Claims, No Drawings

FIRE EXTINGUISHING COMPOSITION

BACKGROUND OF THE INVENTION

Broadly, the invention relates to compositions useful to extinguish fires. More specifically, the invention pertains to a composition which upon ignition emits and disseminates a fire extinguishing agent.

Present fire control systems in aircraft, vehicles and buildings, etc. provide for the pressure dissemination of a stored supply of fire extinguishing agent from a central container through an array of pipes or hoses leading to areas of fire hazard. The delivery system and the central container occupy space and add weight, particularly a problem in aircraft or vehicles. Furthermore, the propellant is usually stored at high pressure, requiring a heavy thick-walled container.

It would be advantageous to employ a compact, light weight fire extinguishing agent which could obviate the need for a complex piping system.

U.S. Pat. No. 3,641,935 discloses a solid fuel pressure cartridge which upon combustion releases a gas usable as a propellant, e.g. in fire extinguishing devices.

U.S. Pat. No. 3,707,918 discloses an aerosol disseminator in which a solid agent, e.g. an insecticide, is eroded, atomized, vaporized and expelled.

U.S. Pat. No. 3,713,383 discloses a dispensing device from which toxicant particles can be projected long distances upon explosion of a particularly constructed burster tube.

SUMMARY OF THE INVENTION

The composition comprises a heat and gas producing pyrotechnic composition comprising, by weight per cent, 25 to 85 per cent of a halogen containing fire extinguishing agent, 15 to 45 per cent of an oxidizer, and 3 to 50 per cent of a binder are cured into a solid mass of desired shape. Desirably up to 2 weight per cent of a cure catalyst may be added into the above mixture to promote the curing of said mixture. An igniter is desirably attached to permit the remote control ignition of the composition. Upon ignition of said composition, the halogen containing compound is vaporized, recondensed and distributed over the fire area.

DETAILED DESCRIPTION OF THE INVENTION

The halogen containing compound used herein must possess fire extinguishing ability; that is, when brought into contact with a fire, it must exert an extinguishing effect on the fire. Also, it must be capable of being thermally disseminated over the fire area. Although it is preferred that the halogen-containing fire extinguishing compound be a solid at ambient as well as operating temperatures, the compound may be a liquid if, upon addition of the binder, the composition cures into a solid mass. Hexachlorobenzene, hexabromobenzene and perchloropentacyclodecane are particularly useful in aircraft engine environments due to their high melting points, which allow them to remain intact at the high operating temperatures present in such environments. Additionally, any halogen containing compound possessing the above required properties may be used. Representative examples include ar-dibromotoluene; 1,2,3,4-tetrachlorodibromobutane; deca-bromodiphenyl oxide; tribromopentyl alcohol; ar-tetrabromo-x-diethyl benzene; ar-tetrabromo-o-xylene; octachloronaphthalene; pentachlorotoluene; 1,2,4,5-tetrabromobenzene; 1,2,4,5-tetrachlorobenzene; polybrominated naphthalenes; dibromotetrafluoroctane; 1,2-dibromo-1,1-dichloroethane; 1,2-dibromo-3-chloropropane and ar-dibromoethylbenzene.

The halogen containing compound should comprise from 25 to 85 weight per cent of the composition, preferably 35 to 60 per cent.

The oxidizer must be a material capable of sustaining the combustion of the binder agent during the vaporization of the halogen-containing compound. Specifically usable compounds include potassium chlorate, potassium perchlorate, sodium chlorate, and sodium perchlorate. Other representative oxidizers include, e.g., ammonium perchlorate; ammonium nitrate; potassium nitrate; and sodium nitrate. The oxidizer should comprise from 15 to 45 weight per cent of the composition, preferably 20 to 35 per cent.

The binder material, ordinarily a liquid until set up, performs several functions. First, it contributes cohesiveness to the composition e.g. it cures in admixture with the oxidizer and the halogen containing compound so as to bind the mixture together as a coherent mass. Such bonding is important because it permits the composition to remain intact during handling and while present in a given application awaiting use. Second, the binder imparts processability to the composition, i.e. makes it formable, e.g. in a mold, into a desired shape. Third, the binder acts as the fuel whose combustion in the presence of the oxidizer vaporizes the halogen containing fire extinguishing agent and causes its distribution over the fire area.

The binder material must not melt or decompose after curing in the environment in which the composition is to be carried. The binder material may be selected from among the substantial number of binders known in the art of pyrotechnic formulation. Such binders include a resin, e.g. epoxy resins, polyester resins, aziridines, polyurethanes or polyesters, and may also include curing additives, e.g. polyepoxides, amine, amine terminated polyalkylene oxides or polyamines. Teachings of various binder materials may be found in one or more of U.S. Pat. Nos. 3,418,183; 3,490,967; 3,511,725; 3,589,954; 3,614,935; 3,627,596; 3,673,014 or 3,680,483, for example, the teachings of which are specifically incorporated herein by reference.

The binder should comprise from 3 to 50 weight per cent of the composition, preferably 3 to 35 per cent. The particular binder-oxidizer combination utilized herein must burn at a temperature hot enough to vaporize the fire extinguishing composition but not so hot as to ignite or decompose the fire extinguishing composition.

In the usual case the oxidizer and the fire extinguishing agent are both solids, and addition of the liquid binder results in the formation of a slurry. This slurry can desirably be cast or molded into a shape appropriate for mounting in a zone of fire risk in a compact and unobtrusive manner. Alternatively, a solid binder material may be used and the resulting solid mixture may be pressed into the desired shape. However, casting is preferred over pressing, particularly wherein the mixture is heat or pressure sensitive or where a complicated shape is desired of the composition.

The slurry may be permitted to cure into a solid mass by the passage of time or by the application of heat. If heat is applied, care should be taken that the components of the mixture are not vaporized and thereby lost from the composition prematurely. A small amount of a cure catalyst may desirably be added to the mixture of halogen containing compound, oxidizer and binder to accelerate the curing of the composition.

Representative cure catalysts include, e.g. tertiary amines, Lewis acids, and metal oxides. Choice of an appropriate cure catalyst will depend on the particular components used in the mixture and will be readily evident to workers in the field of the invention. The cure catalyst should comprise up to about 2 weight per cent of the composition, preferably up to about 0.5 per cent.

The present composition, after curing, is fitted with appropriate ignition means, e.g. an igniter and a fuse. Upon ignition the mass burns to thermally disseminate the halogen containing compound. Thermal dissemination connotes a process in which the halogen containing compound is vaporized and released from the composition or the container holding the composition, recondensed, and then distributed in particulate form over the fire area. The fire extinguishing effectiveness of the present composition depends on the efficiency of the thermal dissemination and on the fire extinguishing effectiveness of the halogen containing compound.

It is anticipated that the composition of the present invention will be utilized for a wide variety of fire extinguishing applications, including, for example, fires in jet engines, chemical processing equipment such as reactors, stills and driers, electronic equipment, vehicles and buildings. The composition may be provided with ignition devices permitting manual, remote controlled, or sensor actuated activation. For example, one anticipated use of this invention is to place a cured mass of the present composition in each engine nacelle of an aircraft and to provide a remote controlled igniter with each mass. The fire extinguishing composition of this invention could be activated by the pilot in response to a fire warning signal from the nacelle or engine fire detector.

EXAMPLE 1

A metal 35 mm. film can was filled with 25 grams (g.) of a slurry composition comprising, as per cent by weight

| | | |
|---|---|---|
| Binder: | a carboxyl terminated polyglycol | 12.93% |
| | an epoxy resin | 12.02 |
| Cure Catalyst: | tridimethylaminomethylphenol | .20 |
| Oxidizer: | potassium chlorate (solid) | 29.94 |
| Fire Extinguishing Agent: | hexabromobenzene (solid) | 44.91 |

This composition was cured at 70°C for a period of 17 hours, resulting in a hard solid. To the top of the solid mass was attached an igniter composition, to which was attached a fuse. The igniter composition contained, by weight, 30% $Ba(NO_3)_2$, 25% $KClO_4$, 10% $Fe_3O_4$, and 35% of a binder comprising a carboxyl terminated polyglycol and an epoxy resin. The fuse was a length of "Thermalite Igniter Cord" manufactured by the Canadian Safety Fuse Co.

A hole about three eighths in. in diameter was drilled in the lid of the can which was then sealed in place, forming a nozzle for the discharge of the hexabromobenzene fire extinguishing agent.

A one inch layer of gasoline was placed in a one gallon paint can and then was ignited. After the fire had burned for at least 30 seconds, the subject fire extinguishing composition was ignited and held about 1 foot above the can. Heavy gray smoke was emitted for 20 seconds, but the flames were extinguished within 10 seconds of the ignition of the subject composition.

In a similar manner ethyl acetate and No. 2 fuel oil were, in separate tests, ignited and subjected to the fire extinguishing effect of the composition defined directly hereinabove. They too were extinguished within 10 seconds.

In a similar manner gasoline was ignited in a wind of about 15–25 mph. and was also extinguished within 10 seconds by the use of the same composition.

EXAMPLE 2

A metal 35 mm. film can was filled with 25 g. of a castable slurry composition comprising, as per cent by weight

| | | |
|---|---|---|
| Binder: | tris[2-1(1-aziridinyl)ethyl]-trimellitate | 21.00% |
| | triethylenetetramine | 6.50 |
| Oxidizer: | potassium chlorate | 27.50 |
| Fire Extinguishing Agent: | hexabromobenzene | 45.00 |

This composition was cured as in Example 1, fitted with the same type fuse and igniter as described in Example 1, and subjected to separate fire extinguishing tests on gasoline, ethyl acetate, and No. 2 fuel oil according to the procedure used in Example 1. Again the fires were extinguished within the first 10 seconds of the approximately 20 second period during which the instant fire extinguishing composition burned.

EXAMPLE 3

In this example the fire extinguishing effectiveness of pyrotechnically disseminated hexabromobenzene was compared with a sprayed stream of dibromodifluoromethane. A 3 foot long section of 4 inch diameter cast iron pipe was partially capped at each end and placed in a horizontal position. The bottom of the pipe was completely covered with 1.5 quarts of fuel oil which was ignited over its whole surface area. The pipe was positioned so as to permit the wind to blow through the pipe. The fire extinguishing agents were introduced from the upwind end of the pipe, the dibromodifluoro methane being sprayed from a volumetric syringe against a small metal plate to produce a mist. The pyrotechnic fire extinguishing composition from which the hexabromobenzene was disseminated on ignition comprised, by weight, 60% hexabromobenzene, 31% $KClO_4$, and 9% of a binder comprising a carboxyl terminated glycol and an epoxy resin. Time required for total extinguishment and amounts of fire extinguishing agent employed were measured.

Comparative Performance of Fire Extinguishing Methods

| Test | Agent | Method of Application | Test Conditions: Ignition Time (min.) | Test Conditions: Wind Velocity (mph) | Extinguishment Results: Agent Used (g) | Extinguishment Results: Time to Extinguish (sec.) |
|---|---|---|---|---|---|---|
| Run 1 | Hexabromobenzene | pyro dissemination | 4.5–5.0 | 10 | 5.8 | 13.0 |
| Comparative 1 | Dibromodifluoromethane | spray | 4.5–5.0 | 10 | 17.1 | 13.0 |
| Run 2 | Hexabromobenzene | pyro dissemination | 3.5–4.0 | 14 | 1.5 | 3.2 |
| Comparative 2 | Dibromodifluoromethane | spray | 3.5–4.0 | 14 | 11.4 | 1.2 |

It is seen that significantly less pyrotechnically disseminated hexabromobenzene was required than the sprayed dibromodifluoromethane to fully extinguish the fires.

What is claimed is:

1. A fire extinguishing composition comprising a solid mixture of:

a. 25 to 85 weight percent a thermally disseminable halogen-containing compound possessing fire extinguishing ability selected from the group consisting of hexachlorobenzene, hexabromobenzene, perchloropentacyclodecane, ar-dibromotoluene, 1,2,3,4-tetrachlorodibromobutane, decabromodiphenyl oxide, tribromopentyl alcohol, ar-tetrabromo-x-diethyl benzene, ar-tetrabromo-o-xylene, octachloronaphthalene, pentachlorotoluene, 1,2,4,5-tetrabromobenzene, 1,2,4,5-tetrachlorobenzene, polybrominated naphthalenes, dibromotetrafluoroctane, 1,2-dibromo-1,1-dichloroethane, 1,2-dibromo-3-chloropropane, and ar-dibromoethylbenzene;

b. 15 to 45 weight percent an oxidizer; and c. 3 to 50 weight percent a binder fuel;

said halogen-containing compound being uniformly dispersed throughout the solid mixture.

2. The composition of claim 1 wherein the halogen containing compound comprises 35 to 60 weight per cent of the composition, the oxidizer comprises 20 to 35 weight per cent of the composition, and the binder comprises 3 to 35 weight per cent of the composition.

3. The composition of claim 1 further including a cure catalyst in an amount at least sufficient to have accelerated curing of the composition, but not in excess of about 2 weight percent of the composition.

4. The composition of claim 3 wherein the cure catalyst comprises up to about 0.5 weight percent of the composition.

5. The composition of claim 1 wherein the halogen containing compound is selected from the group consisting of hexachlorobenzene, hexabromobenzene and perchloropentacyclodecane.

6. The composition of claim 1 wherein the oxidizer is selected from the group consisting of sodium chlorate, potassium chlorate, sodium perchlorate and potassium perchlorate.

7. A method of extinguishing a fire comprising:

a. providing a solid mixture comprised of, by weight, i. 25 to 85 percent a thermally disseminable halogen-containing compound possessing fire extinguishing ability, ii. 15 to 45 percent an oxidizer, and iii. 3 to 50 percent a binder fuel, said oxidizer and binder fuel being selected and provided in proportions such that the temperature of the burning composition is sufficient to vaporize but not ignite or decompose said halogen-containing compound, b. thermally disseminating the halogen-containing compound by igniting said solid mixture, and c. distributing a fire extinguishing amount of the thermally disseminated halogen-containing compound over the fire area.

8. The method of claim 7 wherein the halogen-containing compound is selected from the group consisting of hexachlorobenzene, hexabromobenzene, perchloropentacyclodecane, ar-dibromotoluene, 1,2,3,4-tetrachlorodibromobutane, decabromodiphenyl oxide, tribromopentyl alcohol, ar-tetrabromo-x-diethyl benzene, ar-tetrabromo-o-xylene, octachloronaphthalene, pentachlorotoluene, 1,2,4,5-tetrabromobenzene, 1,2,4,5-tetrachlorobenzene, polybrominated naphthalenes, dibromotetrafluoroctane, 1,2-dibromo-1,1-dichloroethane, 1,2-dibromo-3-chloropropane, and ar-dibromoethylbenzene.

9. The method of claim 8 wherein the halogen-containing compound is hexachlorobenzene, hexabromobenzene, or perchloropentacyclodecane.

10. The method of claim 7 wherein the oxidizer is sodium chlorate, potassium chlorate, sodium perchlorate, or potassium perchlorate.

11. The method of claim 7 wherein, by weight, the halogen-containing compound comprises 35 to 60 percent of the composition, the oxidizer comprises 20 to 35 percent of the composition.

12. The method of claim 7 wherein the solid mixture includes a cure catalyst in an amount at least sufficient to have accelerated the curing of the composition, but not in excess of about 2 weight percent of the solid mixture.

* * * * *

UNITED STATES PATENT AND TRADEMARK OFFICE

CERTIFICATE OF CORRECTION

PATENT NO. : 3,972,820

DATED : August 3, 1976

INVENTOR(S) : Harold E. Filter et al.

It is certified that error appears in the above-identified patent and that said Letters Patent are hereby corrected as shown below:

Column 2, line 38, change "amine" to --amines--.

Column 4, line 1, insert a hyphen -- - -- between "three and eights".

Column 5, Claim 2, insert a hyphen -- - -- at the end of line 42.

Column 5, Claim 2, line 44, change "per cent" to --percent--.

Column 5, Claim 2, line 45, change "per cent" to --percent--.

Column 6, Claim 11, line 54, after the word "composition", insert --, and the binder comprises 3 to 35 percent of the composition--.

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*